US005158813A

United States Patent [19]

Mecke et al.

[11] Patent Number: 5,158,813

[45] Date of Patent: Oct. 27, 1992

[54] THERMAL PRINTING RIBBON

[75] Inventors: Norbert Mecke, Hanover; Heinrich Krauter, Neustadt, both of Fed. Rep. of Germany

[73] Assignee: Pelikan AG, Hanover, Fed. Rep. of Germany

[21] Appl. No.: 474,267

[22] Filed: Feb. 2, 1990

[30] Foreign Application Priority Data

Feb. 3, 1989 [DE] Fed. Rep. of Germany ..... 3903259

[51] Int. Cl.[5] ..... B41M 5/26

[52] U.S. Cl. ..... 428/327; 428/195; 428/206; 428/207; 428/484; 428/488.4; 428/913; 428/914

[58] Field of Search ..... 428/195, 206, 484, 488.4, 428/913, 914, 327, 207

[56] References Cited

U.S. PATENT DOCUMENTS 4,783,360 11/1988 Katayama et al. ..... 428/195

FOREIGN PATENT DOCUMENTS

| | | | |
|---|---|---|---|
| 0106663 | 4/1984 | European Pat. Off. | 428/195 |
| 3406470 | 8/1985 | Fed. Rep. of Germany | 428/195 |
| 3635141 | 3/1988 | Fed. Rep. of Germany | 428/195 |
| 58-219071 | 12/1983 | Japan | 428/195 |
| 62-218172 | 9/1987 | Japan | 428/195 |

OTHER PUBLICATIONS

Japanese Abstract No. 58-219071, Dec. 20, 1983.
Japanese Abstract No. 62-218171, Sep. 25, 1987.

*Primary Examiner*—Pamela R. Schwartz
*Attorney, Agent, or Firm*—Herbert Dubno

[57] ABSTRACT

A thermocolor ribbon, especially a thermocarbon ribbon has a wax and/or plastic binder which melts at a thermal printer temperature to transfer the melt color layer consisting of that binder and polymer particles containing a coloring agent embedded in that binder. The polymer particles melt at a higher temperature to which the thermal print symbol is subjected, e.g. by radiant heating, to fix the image and distribute the coloring agent of the particles in the entire symbol transferred.

13 Claims, 2 Drawing Sheets

THERMAL PRINTING RIBBON

CROSS REFERENCE TO RELATED APPLICATIONS

This application is related to the commonly assigned copending application Ser. No. 07/152,641 filed Feb. 5, 1988, now abandoned; and U.S. Pat. Nos. 5,017,428; 4,995,741; 5,019,421; and 4,938,617. See also U.S. Pat. No. 4,895,465 and U.S. Pat. No. 4,898,486.

FIELD OF THE INVENTION

Our present invention relates to a thermally activated ribbon for transferring a symbol to a substrate, e.g. paper, utilizing a thermal printing head or other symbol transfer means and referred to generally as a thermocolor ribbon generally and, in the case where the pigment is carbon, as a thermocarbon ribbon. More particularly, the invention relates to a thermal transfer ribbon of this type which comprises a conventional ribbon support, e.g. a film, foil or web, on one side of which a pigmented or colored transfer layer is provided which comprises a wax or synthetic resin (plastic) binder adapted to melt at the transfer temperature and under transfer conditions to permit a transfer of all or part of that layer in the symbol pattern to the substrate.

The binder includes, as noted, a coloring agent which generally has a color contrasting with that of the substrate so that the transfer layer can be referred to as a meltable color.

The invention specifically relates to a ribbon of the aforedescribed type which is capable of generating a scratch resistant, heat stable symbol marking on a substrate, to a method of making the thermocolor ribbon and to a method of utilizing that ribbon in the production of a scratch resistant heat stable marking, i.e. a method of transferring symbols or images to a substrate.

BACKGROUND OF THE INVENTION

Thermocolor ribbons have long been known and used. In general they may comprise a foil-like support, e.g. of paper, of a synthetic resin or plastic, or the like coated with a melt color in the form of a plastic and/or wax bonded dyestuff or pigment, collectively referred to herein as a coloring agent. Specifically, the meltable color could be a plastic and/or wax bonded carbon black layer.

The melt color is brought to its melting point by means of a thermal printing head (see the aforementioned copending applications) and, upon contact with a receiving substrate, such as writing paper, is transferred to the substrate paper in a pattern determined by the actuation of the head.

Thermal printers and thermal printing heads which can be used for this purpose are likewise known. These heads can utilize pin arrays to build the symbol which is transferred from a plurality of heated points. The symbols can be alphanumeric characters, such as letters or numbers, or other patterns which can be used in graphics or to build up more complex images.

The thermal printing head presses the thermocolor ribbon against the symbol receiving paper and locally heats the melt color to a molten state to effect the transfer to the paper sheet. The oncoming unused thermocolor ribbon may be delivered by a supply spool while the used portion of the thermocolor ribbon can be wound up on a take-up spool.

The thermocolor ribbon can have a plurality of melt colors disposed one adjacent another. Utilizing a combination of the colors blue, yellow, red and black, for example, it is possible to generate colored images. Thermal printers of the aforedescribed type can operate at high speeds, for example, printing an A4 format sheet according to the German Industrial Standard in about 10 seconds without excessive noise generation.

Apart from the thermocolor ribbons described above, there are thermocolor ribbons in which the heated symbol is not generated by the heated printing head but the ribbon is locally heated by resistance heating utilizing a special foil-like carrier. The melt color which is the functional layer in the printing process is brought to the fusion temperature by the electrical heating and a transfer of a symbol pattern can be effected. Such ribbons are referred to as electrothermal ribbons or ETR ribbons.

By and large the printing process described above, if the transfer is made to paper, produces an image or transferred symbol which is not scratch resistant. Such resistance is, however, very necessary in a variety of technical fields. For example, it is essential for the labeling or tagging of tools, workpieces and the like which may be subjected to significant mechanical action and stress.

Such resistance here is defined as the ability of the transferred image to resist mechanical deterioration by rubbing, the movement of sharp edges over the surface and the resistance to abrasive surfaces.

OBJECTS OF THE INVENTION

It is the principal object of the present invention to provide an improved thermocolor or thermal printing ribbon whereby drawbacks of earlier thermocolor ribbons are avoided and the image produced by the thermocolor ribbon, especially a thermocarbon ribbon, will have great resistance to abrasion and scratching.

Another object of this invention is to provide an improved thermocolor ribbon, especially a thermocarbon ribbon, which is free from disadvantages of earlier systems.

It is also an object of this invention to provide an improved method of making a thermocolor ribbon.

Still another object of this invention is to provide an improved method of using a thermocolor ribbon, i.e. an improved method of producing an image utilizing a thermocolor ribbon.

SUMMARY OF THE INVENTION

These objects and others which will become apparent hereinafter are attained, in accordance with the present invention by providing in the melt color of the ribbon polymer particles, i.e. spheroids, ball-like particles, globules or granules containing a coloring agent and preferably a dyestuff and which are nonmelting during the thermal printing process but which melt during a subsequent heat treatment, i.e. a subsequent heating after the thermal printing process.

According to the invention, the meltable color of the ribbon comprises a binder which melts during the thermal printing process. Within this class, any of the melting binders of the above-identified copending applications may be used, although best results are obtained with paraffin, natural waxes like carnauba wax, beeswax, ozocerite and paraffin waxes, synthetic waxes like synthesis wax, ester waxes, partly saponified ester waxes, polyethylene waxes and polyglycols. This listing should not be considered to exclude any other wax which is capable of melting at the thermal transfer temperature, is capable of bonding to the carrier foil, and can receive the particles or microspheres described above and can form a dispersing phase for the coloring agent.

Plastic binders which can be used in place of such waxes or in admixture with them include ethylene/vinylacetate copolymers, polyvinyl ethers, polyethylenes and hydrocarbon resins. Best results have been obtained when the waxes and plastics are used in a mutual admixture of preferably one part by weight of the plastic component (one or more of the plastics) with two parts by weight of the wax component (one or more of the waxes described).

Best results are obtained, in accordance with the invention when the melt color or color transfer layer comprises about 20–70% by weight of the binder and about 30–80% by weight of the polymer particles.

The polymer particles of the invention, of course, need not be perfectly spherical but generally are ball shaped and can be referred to herein as microspheres, balls or granules. In general they have diameters of 0.3 to 3.0 micrometer and preferably between 1 and 10 micrometers. The type of coloring agent contained within the microspheres can be a pigment and/or a dyestuff as these are defined in the aforementioned copending application. Preferably the polymer particles contain about 1O–30% by weight of the coloring agent with the balance being constituted by a fusible polymer. The preferred coloring agent is a pigment, especially carbon black.

The polymer plastic of the coloring agent containing polymer particles can be constituted of polystyrene and styrene copolymers, polyvinyl acetate, polyamides, maleic acid resins, styrene hydrocarbon resins, (meth-)acrylate, polyvinylchloride, phenolic resins, polyvinylether and/or epoxy resins. The important requirement of the invention is that these materials have a melting point or softening point which differs from that of the binder of the melt color. As a consequence, during the thermal printing process, the polymer particles or toner particles do not melt at all or melt only slightly while a portion of the melt color containing the wax and/or plastic binder in which the particles are incorporated and embedded, does melt and is transferred to the substrate.

This requirement is satisfied for the plastic in the polymer particles when its melting point or softening point lies between 80° and 200° C., especially between 100 and 150° C. and is greater by at least several degrees than the temperature at which thermal printing takes place and, of course, is also greater than the melting point of the binder.

The polymer particles embedded in the melt color of a thermocarbon ribbon of the invention can thus be compared with the meltable toner particles which are conventionally used in dry copying apparatus.

The thickness of the melt color layer of the thermocarbon ribbon of the invention can range between 3 and 20 micrometers and preferably is 4–10 micrometers. These values apply to the most practical embodiments of the invention, although it will be understood that the precise thickness is not critical.

The type of carrier used in accordance with the invention is also not critical, for example, we may use polyesters, especially polyethylene terephthalate, polycarbonates, polyamides, polyvinyl compounds especially polyvinyl chloride, polyvinyl acetate, polyvinyl alcohol, polyvinyl propionate, polyethylene, polypropylene and polystyrene. The carrier may also be constituted of condenser paper.

In general, the carrier foil can have a thickness of about 3–12 micrometers and this range can be exceeded or a smaller thickness may be used.

We have found, furthermore, that the choice of the coloring agent is also not critical for the present invention and indeed all of the coloring agents used in copy machine toners or in thermal transfer ribbons heretofore can be used.

The coloring agent can be an inorganic or organic coloring agent either in a natural or a synthetic form. The inorganic coloring agents generally are pigments like carbon black, iron oxide and magnetic pigments.

The organic pigments or dyestuffs can be those which are known from toner technology, including Nigrosin and Phthalocyanine-Blue.

The polymer particles utilized in the thermocarbon ribbon of the invention can be fabricated by the techniques which have become conventional for the fabrication of toner particles for the copying machine industry. These techniques include melting the plastic of the polymer particles and the coloring agent together and extruding the mixture of the coloring agent and the synthetic material with subsequent granulation and milling.

The following method has been found to be particularly advantageous for the fabrication of the thermocolor ribbon of the invention:

The coloring agent containing polymer particles are dispersed in a commercially available aqueous dispersion of the binder, especially in the form of a mixture of a wax and a plastic melting at the thermal printing temperature.

The commercially available dispersions which are used generally contain 30–50 weight % of the plastic of the binder and preferably about 40 weight % thereof, i.e. contain 30–50 weight % and preferably 40 weight % solids.

The dispersion containing the polymer particles can be applied to the carrier by conventional techniques, for example, the coating can be applied in an amount of 3 to 20 g/m$^2$ (with respect to the dry content of the dispersion) on the foil. A doctor blade or like coating technique can be used. The cooling is applied preferably at room temperature and the coated carrier is then passed through a drying tunnel in which the aqueous phase of the aqueous dispersion is evaporated.

Of course, a dispersion can be formed in a melt whereby, for example, a system including a molten wax and/or a molten plastic forming the binder phase and the coloring agent containing polymer particles is applied by melt cooling techniques, for example, screen printing techniques to the carrier.

It is important in this case that the melting point of the polymer particles be sufficiently greater than that of the binder phase so that during the coating the polymer particles will not themselves melt.

Furthermore, the polymer particles should be insoluble in the binder phase.

According to the invention, the imprint is made on the substrate, e.g. the paper, in the usual manner utilizing a thermal printing head. After the symbol has been transferred to the substrate, the latter is subjected to a further heating step to fix the symbol on the paper, this further heating step being analogous to the fusion which occurs in a copying machine. The polymer of the particles is brought to a temperature equal to or greater than its melting point so that the coloring agent is released and can diffuse throughout the binder of the symbol transferred to the paper and to the paper itself.

Following this fixing stage, the symbol is found to have a high degree of scratch resistance because the fixed symbol appears to have a closed phase which prevents the polymer particles from separating from the binder and vice versa.

The effect will be described in greater detail below with reference to the drawing.

It should be noted that the further heating can take place by contact of the paper with a heated platen, by subjecting the substrate to infrared heating, resistance heating or heating from another source. Since the symbol is already on the substrate at the time this additional heating takes place, there is no danger that the transferred symbol will be lost.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
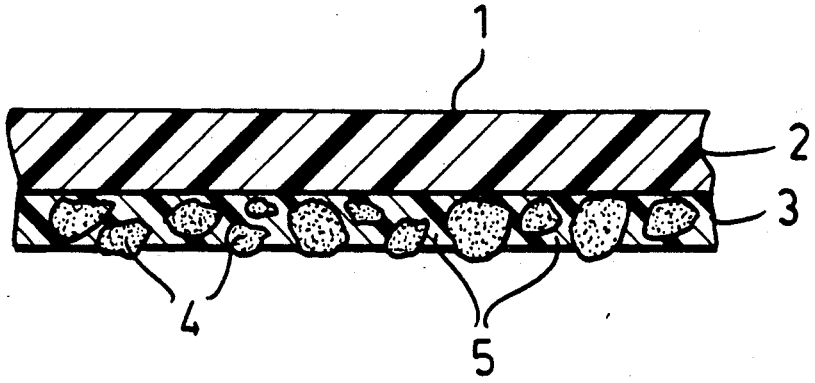
FIG. 1 is a diagrammatic cross section of the ribbon according to the invention.
Figure 2:
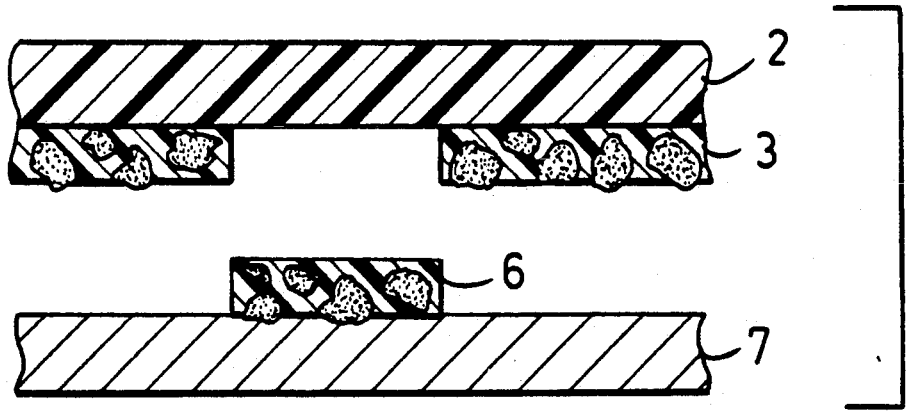
FIG. 2 is a cross sectional view illustrating the thermal printing system and showing the system in highly diagrammatic form following transfer of a symbol to a substrate.

In FIG. 1 we have shown a thermal transfer ribbon, also referred to as a thermocolor or thermocarbon ribbon which comprises a carrier 2 of a polyethylene terephthalate of a thickness of 6 micrometers and a layer of melt color 3 of a thickness of about 8 micrometers.

In the meltable color layer 3 of the thermal printing ribbon 1, coloring agent polymer particles 4 are distributed and are held in place by a binder 5 in the form of a mixture of paraffin wax and ethylene/vinylacetate copolymer. The polymer particles 4 are embedded in the binder 5. The polymer particles themselves may include a dyestuff which can be dissolved in the polymer particles but generally will also contain carbon black and this has been symbolized by stippling. In practice, the imprint will generally be jet black but this cannot be shown in the drawing without the use of solid black and interfering with reproducibility of the drawing.

The thermal printing process is carried out with a conventional thermal printer as described in the aforementioned copending applications. The print may be applied to a paper substrate or some other substrate. During the thermal printing process a symbol 6 of the melt color is applied to the paper 7 and also includes polymer particles 4 embedded in the binder transferred from the ribbon.

Figure 3:
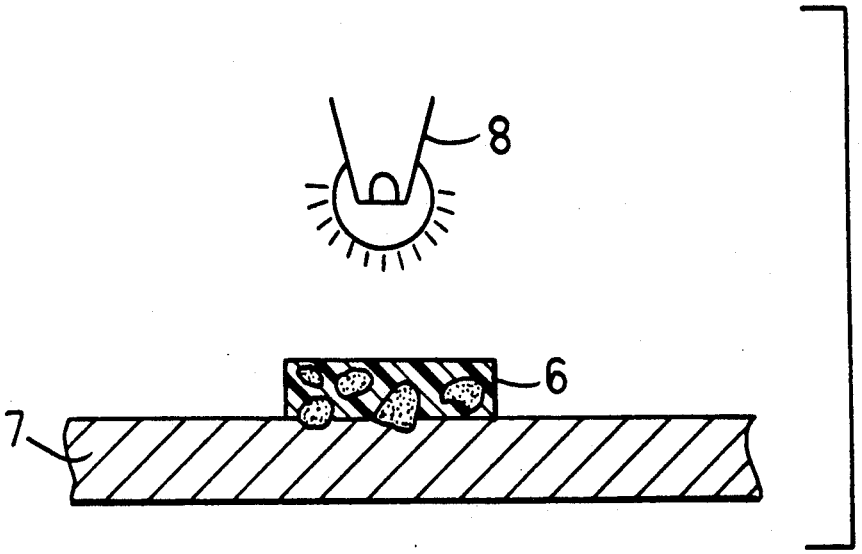
FIG. 3 is a diagrammatic cross section illustrating the step of additional heating utilizing infrared radiation.
Figure 4:
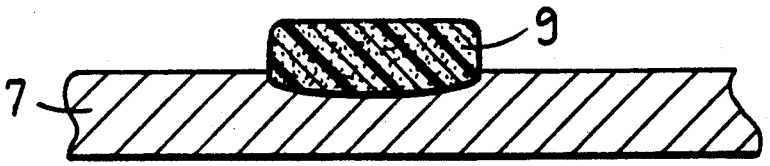
FIG. 4 is a diagrammatic section showing the symbol after the final heating step.

In a subsequent step, represented in FIG. 3, the symbol is subjected to a further heating. This heating may be an infrared heating capable of generating a temperature of 200° C., for example, in the polymer particles which are highly heat absorptive and in which the heating effect is concentrated. The result is the generation of a closed phase 9 in which the pigment particles and the dyestuff are dispersed in the binder of the symbol and a uniform coloration of the latter results. The resulting print is scratch free and highly stable and the method can be applied to the formation of scratch free images on labels and other carriers. The thermal treatment results in a fixing of the image to the substrate with far better effects than can be obtained by ordinary thermal printing.

SPECIFIC EXAMPLES

Formation Of The Toner

An epoxy resin (marketed commercially under the tradename or trademark EUMPOX by Schering) having a melting point of about 120° C. and carbon black in a weight ratio of 90:1 are blended in a heated extruder. At a temperature above the melting point of the epoxy resin, the mixture is homogenized and extruded. The extruded strand is cut up into pieces and ground to a particle size of -8 micrometers in a pin mill.

EXAMPLE 2

Production of Polymer Particles

The method of Example 1 was used but instead of the epoxy resin a styrene copolymer (marketed under the name Radiant Fusing Copolymer by the firm Diamond Shamrock) and having a melting point of about 120° C. was employed. The weight ratio of the styrene copolymer to carbon was about 80:20.

EXAMPLE 3

Formation of the Melt Color 30 parts by weight of the toner of Example 1 is melted together and blended with 20 parts by weight of ethylenevinylacetate (marketed under the commercial name EVA by JCJ) and 50 parts by weight paraffin at 90° C. The melt color is applied at 90° C. by a Flexo printing machine in a thickness of 8 micrometers to a 6 micrometer thick polyester foil.

EXAMPLE 4

Production of the Melt Color 30 parts by weight of the polymer particles of Example 2 are blended with 35 parts by weight of a 35% by weight aqueous polyvinyl acetate dispersion (as marketed under the commercial name Mowilith DC by the firm Höechst) and 50 parts by weight of a 40% by weight aqueous paraffin dispersion (marketed under the commercial name Vikonyl GL by the firm Suddeutsche Emulsions-Chemie). The resulting dispersion is applied by doctor blade to a polyester foil having a thickness of 8 micrometers.

The water is evaporated in air heated to a temperature of 80° C. The dry color layer has a thickness of about 10 micrometers.

The thermocolor ribbons made in Examples 3 and 4 are used in a conventional thermal printer to print symbols on label paper and tag stock and the printed paper is then heated by infrared heating to about 200° C. This causes the polymer particles to melt and distributes the color in the binder of the symbol to leave a closed, unitary and scratch free deposit in the pattern of the symbol on the substrate.

We claim:

1. A thermocolor ribbon for producing a symbol on a substrate with a thermal printer which comprises a carrier and a meltable color layer on said carrier, said meltable color layer comprising a binder selected from the group consisting of waxes, resins and mixtures thereof capable of melting at a thermal printing temperature upon thermal printing to transfer a symbol to said substrate, and coloring agent-containing polymer particles dispersed in and embedded in said binder and melting at a temperature above said thermal printing temperature, said polymer particles not melting at all while said color layer is being melted and transferred during said thermal printing.

2. The thermocolor ribbon as defined in claim 1 wherein said polymer particles are meltable toner particles.

3. The thermocolor ribbon as defined in claim 2 wherein the polymer particles comprise a resin selected from the group consisting of polystyrene, styrene copolymers, polyvinyl acetate, polyamide, maleic acid resins, styrene hydrocarbon resins, (meth-)acrylate, polyvinyl chloride, phenolic resins, polyvinyl ether, epoxy resin and mixtures thereof.

4. The thermocolor ribbon as defined in claim 1 wherein said binder is selected from the group consisting of hydrocarbons waxes, ester waxes, ethylene/vinyl acetate copolymers, hydrocarbon resins and mixtures thereof.

5. The thermocolor ribbon as defined in claim 1 wherein said meltable color layer contains 30 to 80 parts by weight of said polymer particles to about 20 to 70 parts by weight of said binder.

6. The thermocolor ribbon as defined in claim 1 wherein said polymer particles have diameters of about 0.3 to 30 micrometers.

7. The thermocolor ribbon as defined in claim 6 wherein said polymer particles have diameters of about 1 to 10 micrometers.

8. The thermocolor ribbon as defined in claim 1 wherein said polymer particles contain about 10 to 30% by weight coloring agent.

9. The thermocolor ribbon as defined in claim 8 wherein said polymer particles contain about 15 to 20% by weight coloring agent.

10. The thermocolor ribbon as defined in claim 1 wherein said polymer particles contain a pigment at least as part of the coloring agent thereof.

11. The thermocolor ribbon as defined in claim 10 wherein said pigment is carbon black.

12. The thermocolor ribbon as defined in claim 1 wherein said polymer particles contain a resin having a melting point of about 80° to 200° C.

13. The thermocolor ribbon as defined in claim 12 wherein the melting point of said resin is about 100° to 150° C.

* * * * *